US006257139B1

(12) United States Patent
Schaede

(10) Patent No.: US 6,257,139 B1
(45) Date of Patent: Jul. 10, 2001

(54) SHEET PROCESSING MACHINE

(75) Inventor: Johannes Georg Schaede, Würzburg (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 09/642,580

(22) Filed: Aug. 22, 2000

Related U.S. Application Data

(62) Division of application No. 09/284,475, filed as application No. PCT/DE97/02394 on Oct. 16, 1997, now Pat. No. 6,129,468.

(30) Foreign Application Priority Data

Oct. 21, 1996 (DE) ..... 196 43 409
Dec. 20, 1996 (DE) ..... 196 53 403

(51) Int. Cl.[7] ..... B41F 7/14

(52) U.S. Cl. ..... 101/232; 101/408; 198/358; 271/204; 271/277

(58) Field of Search ..... 101/232, 233, 101/238, 240, 237, 408, 409, 411; 198/358, 644, 470.1, 803.7; 209/587; 271/204, 205, 9.12, 9.01, 277

(56) References Cited

U.S. PATENT DOCUMENTS

| | | | | |
|---|---|---|---|---|
| Re. 35,495 | | 4/1997 | Bolza-Schuenemann . | |
| 1,356,990 | | 10/1920 | Barber . | |
| 3,935,814 | * | 2/1976 | Weisgerber | 101/232 |
| 4,015,495 | | 4/1977 | Yerly . | |
| 4,443,094 | * | 4/1984 | Ricciardi | 101/411 |
| 4,552,066 | | 11/1985 | Giori et al. . | |
| 4,805,531 | | 2/1989 | Sarda . | |
| 5,016,182 | | 5/1991 | Bergland et al. . | |
| 5,027,295 | | 6/1991 | Yotsuya . | |
| 5,194,062 | | 3/1993 | Membrino . | |
| 5,235,883 | | 8/1993 | Jeske et al. . | |
| 5,331,387 | | 7/1994 | Okada et al. . | |
| 5,377,587 | * | 1/1995 | Köbler | 101/233 |
| 5,568,767 | | 10/1996 | Jackson . | |
| 5,623,850 | | 4/1997 | Szczepaniak et al. . | |
| 5,810,347 | * | 9/1998 | Wingate | 271/204 |
| 6,062,136 | * | 5/2000 | Bolza-Schünemann | 101/237 |

FOREIGN PATENT DOCUMENTS

| | | |
|---|---|---|
| 549439 | 4/1932 | (DE) . |
| 1088798 | 9/1960 | (DE) . |
| 1175695 | 4/1965 | (DE) . |
| 45732 | 11/1966 | (DE) . |
| 1511067 | 11/1973 | (DE) . |
| 2454056 B2 | 12/1976 | (DE) . |
| 2417614 B2 | 3/1977 | (DE) . |
| 3115688 C2 | 11/1984 | (DE) . |
| 0136972 A1 | 7/1984 | (EP) . |
| 61-254465 | 12/1986 | (JP) . |

* cited by examiner

*Primary Examiner*—Eugene Eickholt
(74) *Attorney, Agent, or Firm*—Jones, Tullar & Cooper, PC

(57) ABSTRACT

Printed sheets are fed into a sheet processing machine where they are separated into partial sheets by being cut longitudinally. The partial sheets are separated laterally from each other by gripper components. Each of the partial sheets can have its leading and trailing ends cut. The cut partial sheets can then be inspected and deposited into a selected one of a plurality of partial sheets stacks.

1 Claim, 4 Drawing Sheets

SHEET PROCESSING MACHINE

This application is a divisional of application Ser. No. 09/284,475 filed on Apr. 21, 1999 now U.S. Pat. No. 6,129,468 and International Application PACT/DE97/02394 filed on Oct. 16, 1997 and which designated the U.S.

FIELD OF THE INVENTION

The present invention relates to a method for transporting sheets and to a sheet processing machine in which sheets are separated into partial sheets. The partial sheets are then separated from each other laterally with respect to a sheet transport direction

DESCRIPTION OF THE PRIOR ART

DE-PS 15 11 067 describes a device for cutting sheets from a web. Here, the web is cut into partial webs, and these partial webs are deflected into different levels prior to being transversely cut. No spacing in the axial direction is provided by this prior art device.

DE 31 15 688 C2 discloses a device for separating usable and waste material to be obtained from a web of material. The usable material is cut out of the web by the operation of a cutting cylinder. The direction of the cut is essentially transversely in relation to the transport direction.

DE-AS 10 88 798 describes a device for separating a web into partial webs. The partial webs are spaced apart by means of guide surfaces and are cut into sheets by means of a transverse cutting device. These sheets fall onto a stack on a feed table.

DE-PS 1 175 695 discloses a processing cylinder with two gripper systems. These two gripper systems are hingedly connected with each other and are displaceable, or respectively pivotable, together.

These two gripper systems cannot be moved in relation to each other in the axial direction.

DE 24 17 614 B2 describes a device for feeding products in connection with a web-fed rotary printing press. In this case, products, which are deposited by paddle wheels and are respectively located next to each other, are conveyed by means of a product carrier.

In the course of the conveyance of the products on the product carrier, a gripper acts on respective lateral edges of the products located next to each other and moves the products transversely away from each other thereby creating a space.

SUMMARY OF THE INVENTION

The object of the present invention is to provide a method for transporting sheets, and a sheet processing machine.

In accordance with the present invention, this object is attained by separating each of a plurality of sheets into partial sheets by using at least one longitudinal cut. The partial sheets are moved apart from each other in the processing machine in a direction transverse to the direction of sheet travel. At least one chain gripper system carries at least two holding systems which are separable laterally and which can each deposit a partial sheet on a selected one of a plurality of sheet stacks. The partial sheets can have been inspected after having been cut.

The advantages which can be achieved by means of the present invention lie, in particular, in that transverse cutting from the start to the end of a sheet takes place without manual intervention in a sheet processing machine. It is possible, by means of integrated inspection devices, to control the print quality itself, as well as to control the cut registrations in the sheet processing machine. In this way, it is possible to simultaneously control the fronts and backs of the sheet, which were printed, for example, on the obverse and reverse sides of the sheet.

A simple cut registration adjustment is possible because of the cooperative operation of the transverse cutting devices with a chain conveyor. This is advantageously performed by means of a position-controlled electric motor driving a cutting cylinder.

A longitudinal cutting device is assigned to a processing cylinder of the sheet processing machine, so that the sheet is cut "in-line" into two or more partial sheets. These sheets can be deposited on stacks, which can be selected by means of the inspection device. In this manner, sorted stacks with "good" and with waste sheets are formed. This has the advantage that, in case of a defective partial sheet the entire sheet, is not wasted.

Furthermore, the partial sheets located next to each other do not interfere with each other during the continued transport, or respectively during processing, in particular during inspection of the partial sheets.

By means of this sheet processing machine, all sides of a sheet are cut and the latter is cut into partial sheets. All cuts made, as well as the obverse and reverse printing, are controlled by means of inspection devices, all the cut partial sheets are deposited on selectable stacks.

This sheet processing machine performs a plurality of processing steps "in-line", which leads to an increase in production and also to a reduction of manual labor. Moreover, the quality of the products made in this way is increased.

BRIEF DESCRIPTION OF THE DRAWINGS

The sheet processing machine in accordance with the invention is represented in the present drawings and will be described in greater detail in what follows.

Shown are in.

DESCRIPTION OF THE PREFERRED EMBODIMENT

Figure 1:
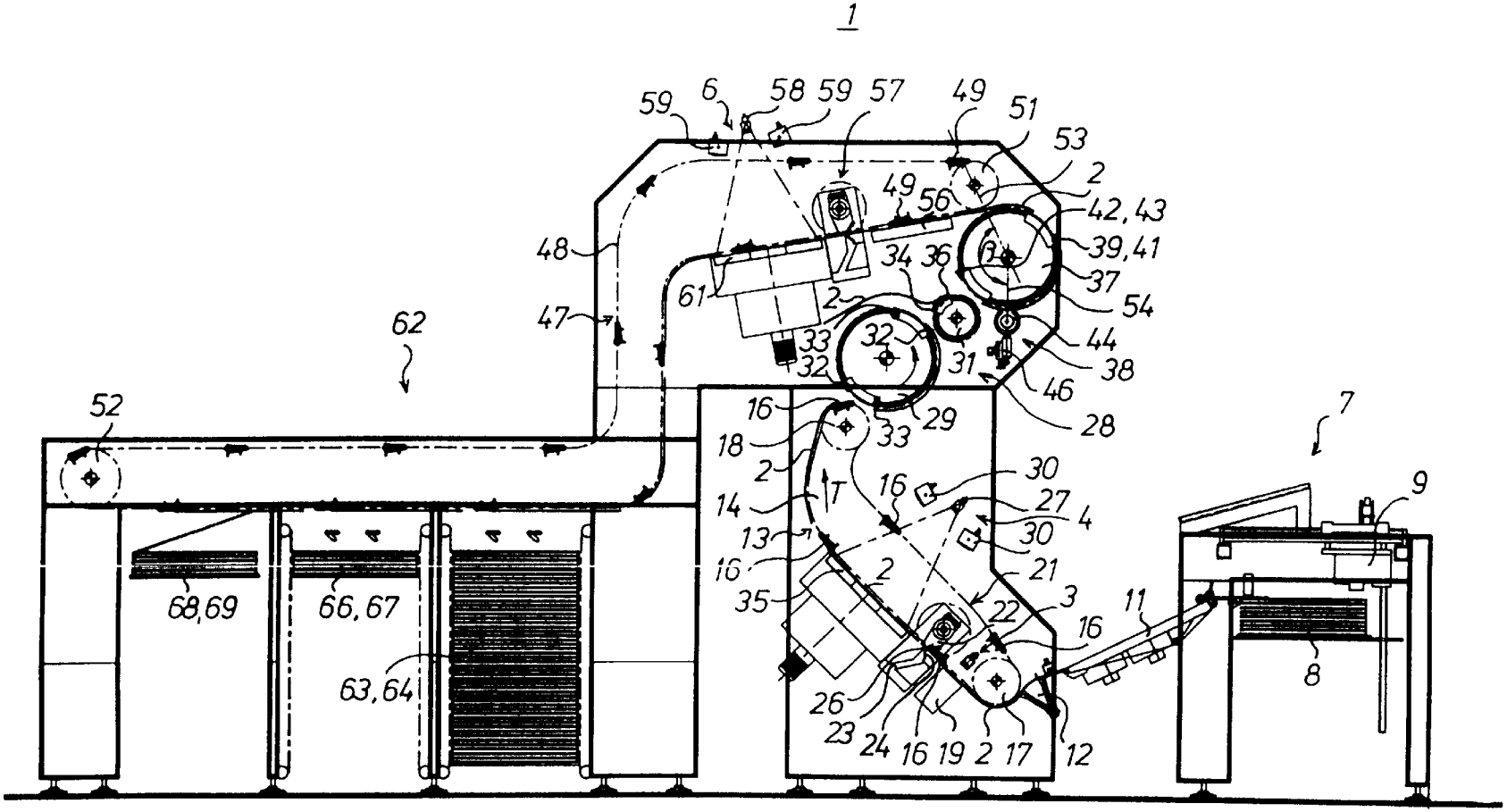
FIG. 1, a schematic lateral view of a sheet processing machine.

A sheet processing machine 1, for the transverse and longitudinal cutting of sheets 2, in accordance with the present invention is shown in FIG. 1, and has integrated inspection devices 3, 4, 6. The sheets preferably are printed paper sheets, for example securities. This sheet processing machine 1 is constructed as will be described in what follows.

A feeder 7 essentially has a first stack 8, a sheet separating device 9 and a delivery table 11. This feeder 7 is followed by an installation 12 which is designed as a swing feeder. A first chain conveyor 13 works together with this swing installation 12. This chain conveyor 13 has a pair of revolving chains 14, to which axially extending chain gripper systems 16 have been attached. The chains 14 are reversed by a first chain wheel carried on a first chain wheel shaft 17, and by a second chain wheel carried on a second chain wheel shaft 18. The chains 14 extend at least partially along a straight line between the first, 17, and second chain wheel shaft 18. Viewed in the transport direction T, the first inspection device 3 is arranged downstream of after the first chain wheel shaft 17. This first inspection device 3 has a suction box 19, whose work surface facing the chain gripper system 16 is made at least partially transparent. Illumination installations, not specifically represented, are arranged under this transparent work surface.

A first transverse cutting device 21 is connected downstream of this suction box 19 of the first inspection device 3. The first transverse cutting device 21 has a rotating cutting cylinder 22 and a stationary opposed cutter 24 fastened on a cross bar 23. The cutting cylinder 22 is provided with at least one axially extending groove, into which a passing chain gripper system 16 can descend. A width of the groove in the circumferential direction of the cutting cylinder 22 is made larger than a width that is required to receive the chain conveyor 16. The cooperating chain gripper systems 16 and the cutting cylinder 22 can be phase-shifted in respect to each other for adjusting the cut registration. In the sheet processing machine in accordance with the present invention, rotating arms are provided on both sides of the cutting cylinder 22, between which an axially extending cross bar is arranged to receive a cutter 26.

The cutting cylinder 22 has a drive, whose phase can be changed in respect to the chain conveyor 13. In the present invention, this drive is advantageously embodied as a separate, position-controlled electric motor.

The stationary opposed cutter 24 is arranged in a slightly oblique direction in respect to the axis of rotation of the cutting cylinder 22, i.e. the opposed cutter forms an opening angle $\alpha$ with the transport direction T, which is not equal to 90°, but is for example 89°. From this, an angle of inclination of the opposed cutter 24 of, for example, 1° in respect to the axis of rotation of the cutting cylinder 22 results. The opposed cutter 24 is also slightly rotated around its longitudinal axis, i.e. the opposed cutter 24 has a slight twist. This insures that the first transverse cutting device 21 will make a cut in the moving sheet which is perpendicular to the longitudial direction of the sheet.

The electric drive mechanism of the cutting cylinder 22 follows the speed of the chain conveyor 13 at an identical circumferential speed. Because of the twist of the cutter 24 and the superimposed conveying speed, an exactly right-angled cut of the sheet 2 is created in the end of sheet 2 as the sheet 2 passes through the first transverse cutting device 21.

The axially extending cutter 26, which is carried by the cutting cylinder 22, is also slightly inclined or angled with respect to the axis of rotation of the cutting cylinder 22 also and has a twist in its longitudinal direction. The cutter 26 of the cutting cylinder 22 and the opposed cutter 24 are matched to each other.

A rotating opposed cylinder which, for example, has an opposed cutter 24 for performing a scissors cut, or an opposed strip, is also possible in place of the stationary opposed cutter 24. It is also possible to design the cutter 26 and the opposed cutter 24 parallel in relation to the axis of rotation of the cutting cylinder 22 and without a twist. The cutting cylinder 22, or respectively the opposed cylinder, can also have several cutters 26.

A second inspection device 4 is installed downstream of this first transverse cutting device 21 in the area of the chain conveyor 13. This second inspection device 4 essentially consists of a sensor 27, illumination devices 30 and a suction box 35.

A sheet turning device 28 follows the chain conveyor 13. In the present invention, this sheet turning device 28 essentially consists of a storage drum 29 and a turning drum 31. The storage drum 29 has a "double" circumference and is therefore equipped with two controllable gripper systems 32, which are arranged offset by 180° in respect to each other, and two oppositely located suction systems 33. A distance in the circumferential direction of the sheet storage drum 29 between each of the gripper systems 32 and the suction systems 33 can be adjusted to the length of the sheets to be conveyed. The suction systems 33 are movable both in the circumferential direction and also in the axial direction of the sheet storage drum 29.

The turning drum 31 has two controllable gripper systems 34, 36, which are placed side-by-side and which are pivotably arranged around their longitudinal axis.

The turning drum 31 and the storage drum 29 can be phase-shifted in respect to each other.

A cylinder 37, for example a processing cylinder 37, and a cooperating longitudinal cutting device 38, are situated downstream of the turning device 28. This processing cylinder 37 is seen most clearly in FIGS. 4 and 5 and has, for example, at least twice the circumference of the turning drum 51 and carries four holding systems 39, 41, 42, 43, which are designed as gripper systems 39, 41, 42, 43 and which are each controllable independently of each other. These holding systems 39, 41, 42, 43 can also be embodied as suction devices. Two of these gripper systems 39, 41, or respectively 42, 43 are respectively located in a cylinder groove approximately axis-symmetrical next to each other in the axial direction in relation to a center of the processing cylinder 37, and are displaceable in relation to each other in the axial direction. In the present invention, one of the gripper systems 39, or respectively 42, located axially next to each other, is arranged fixed in the axial direction, and the second gripper system 41, or respectively 43 of each pair of gripper systems 39, 41 or 42, 43, is displaceable in relation to the first gripper system 39, or respectively 42, for example by means of a cam 40 and cam rollers 45. However, both gripper systems 39, 41, or respectively 42, 43, can be displaceable. The second pair of these gripper systems 42, 43 is located opposite the first pair of two gripper systems 39, 41 designed in this way and is offset by 180°.

Figure 4:
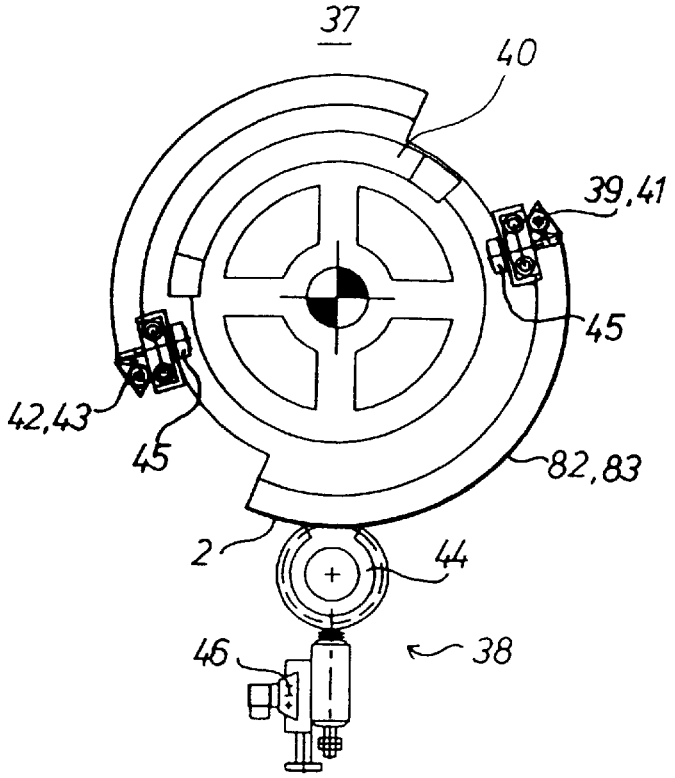
FIG. 4, an enlarged schematic lateral view of a processing cylinder of the sheet processing machine in accordance with FIG. 1; and in FIG. 5, an enlarged schematic view from above on the processing cylinder of the sheet processing machine in accordance with FIG. 1.

The longitudinal cutting device 38 which is also seen most clearly in FIG. 4 and which has a plurality of cutter wheels 44, and which is assigned to the processing cylinder 37, is placed downstream, in the sheet transport direction T, shortly after the turning drum 31. In the present invention, the longitudinal cutting device 38 has an axially extending cross bar 46, on which three cutter wheels are arranged, each of which can be independently actuated and axially displaced.

A second chain conveyor 47 with two rotating chains 48 is arranged after the processing cylinder 37. A plurality of chain gripper systems 49 are arranged on these chains 48. These chain gripper assemblies 49 each consist of two chain gripper assemblies, which are placed next to each other in the axial direction, are approximately symmetrically arranged in relation to the machine center and can be operated independently of each other. In place of the processing cylinder 37, the second chain conveyor 47 can also have chain gripper systems which can be moved in relation to each other in the axial direction.

It is also possible that more than two gripper systems 39, 41, or respectively 42, 43, i.e. any arbitrary number, are displaceable on the processing cylinder 37. In case of three gripper system sets, in which the gripper systems are arranged axially next to each other, the gripper system arranged in the center of each of the three gripper system sets, for example, could be fixed in place in the axial direction, and the two outer gripper systems in each such three gripper system set could be designed so that they can be shifted away from the center system.

The chains 48 are reversed by a first chain wheels shaft 51 and a second chain wheel shaft 52. A median line, constituted by the chain wheel shaft 51 and the processing cylinder 37, forms an opening angle β of less than 180°, for example 155°, with a median line constituted by the processing cylinder 36 and the longitudinal cutter wheels 44.

Figure 2:
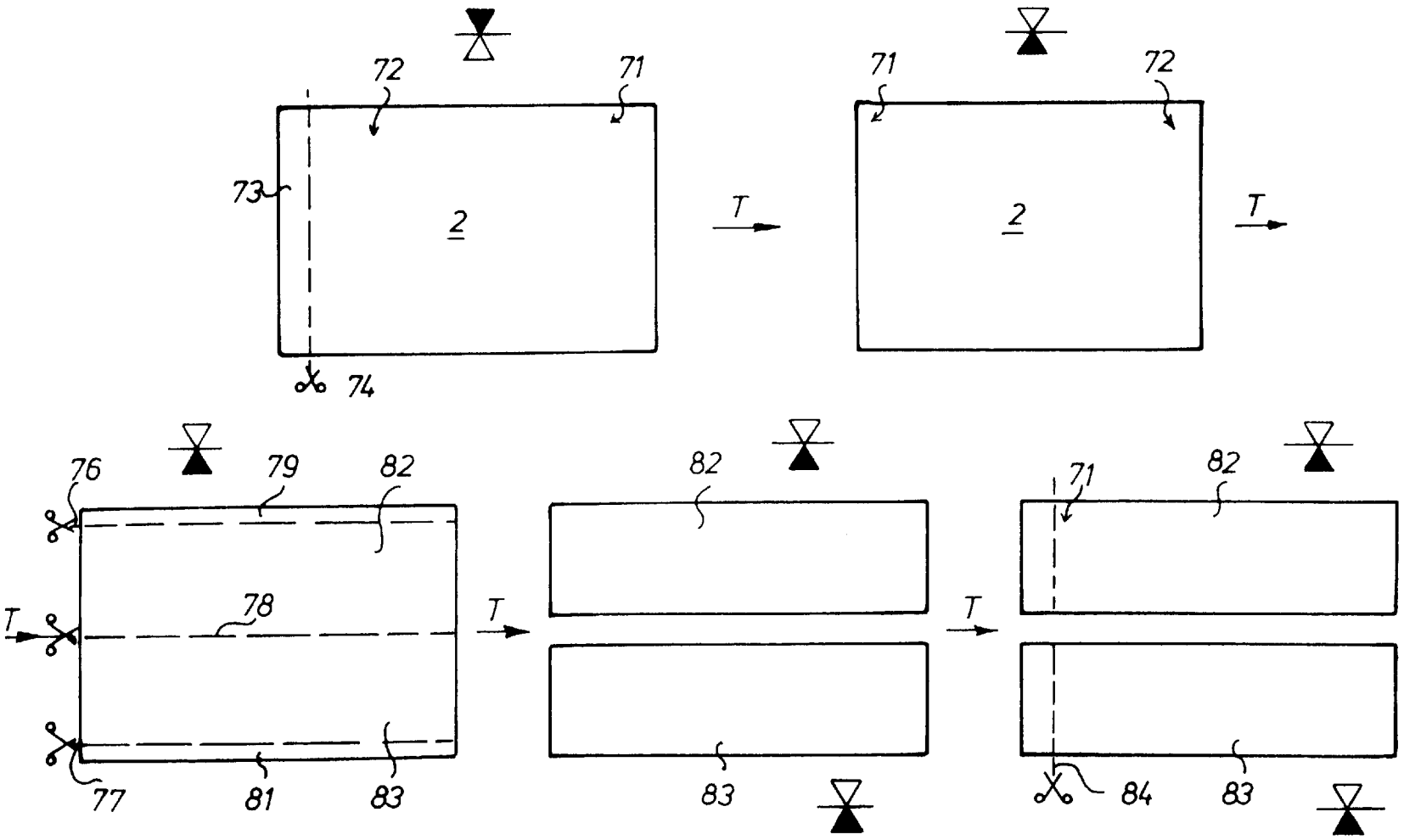
FIG. 2, a schematic representation of the processing steps in the sheet processing machine.

Downstream of the first chain wheel shaft 51 of the second chain conveyor 47, a suction box 56 is arranged in the second chain conveyor 47 underneath the second chain 48. A second transverse cutting device 57 follows this suction box 56, which is constructed in a manner identical with the first transverse cutting device 21. The first and second transverse cutting devices 21, 57 respectively are used for trimming the ends 71, 72 of the sheets 2, 82, 83, as shown in FIG. 2. The third inspection device 6 with a sensor 58, illumination devices 59 and a suction box 61, is connected downstream of this second transverse cutting device 57.

Figure 3:
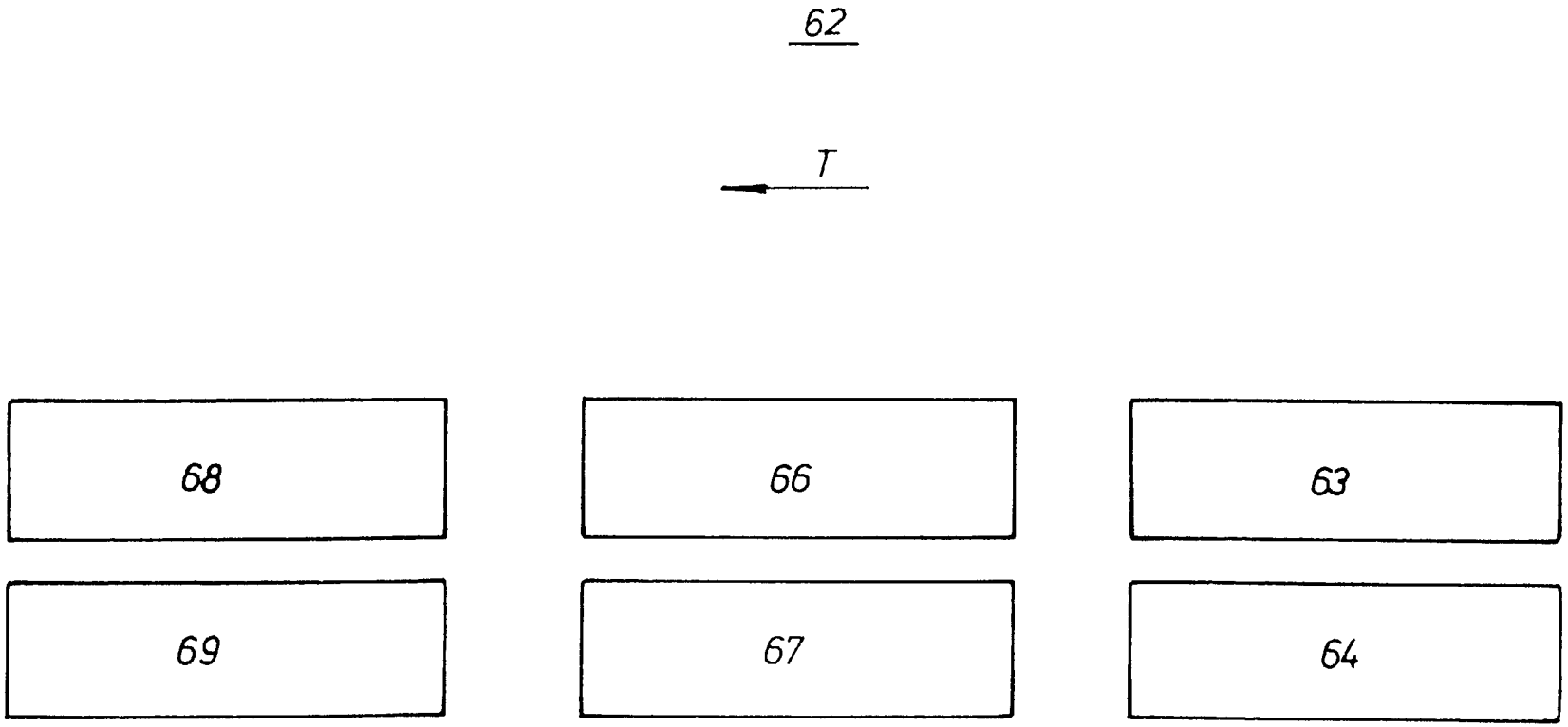
FIG. 3, a schematic view from above on a stack of a delivery device of the sheet processing machine.

A cut sheet feeder 62 in the area of the chain conveyor 47 follows the third inspection device 6. This cut sheet feeder 62 has six stacks 63, 64, 66 to 69, respectively two of which are arranged in pairs next to each other as shown in FIG. 3. The resulting three pairs of stacks 63, 64, or respectively 66, 67, or respectively 68, 69, are arranged behind each other. The stacks 63, 64, or respectively 66, 67, of the first two pairs of stacks respectively have common lifting devices, so that respectively one pair of stacks can be raised and lowered together. Separate lifting devices have been provided for the two stacks 68, 69 located next to each other, so that the two stacks 68, 69 can be raised and lowered independently.

Gripper systems, or respectively chain gripper systems are understood to be a plurality of grippers, which are arranged on a shaft which can be pivoted around a longitudinal axis.

The functioning of the sheet processing machine 1 in accordance with the present invention is as follows:

A sheet 2, in particular a sheet of paper printed on the obverse and reverse sides, is fed from a first stack 8 to the delivery table 11 by the sheet separating device 9. The sheet 2 is grasped from this delivery table 11 by the swing feeder installation 12 and is passed over to a chain gripper system 16 in the area of the first chain wheel shaft 17 of the first chain conveyor 13. The chain gripper system 16 conveys the sheet 2 along the "straight" portion of the chain conveyor 13 to the first inspection device 3. The sheet 2 is checked in segments, for damage, such as, for example tears and holes, by means of the first inspection device 3. The water mark of the sheet 2 is also inspected by the use of back lighting. In the course of this conveyance, the sheet 2 is guided, by the suction box 19, to which a vacuum has been applied, of the first inspection device 3.

The chain gripper system 16 conveys the sheet 2 through the first transverse cutting device 21 to the second inspection device 4. There, the sheet 2 is aspirated by the suction box 35 of the second inspection device 4 in the area of the front of the sheet 2. A trailing end 72 of the sheet 2 is still in the transverse cutting device 21, where a narrow strip 73, which extends in the axial direction of the chain gripper system 16, is cut off the trailing end 72 of the sheet 2. In this case, the conveying speed of the chain conveyor 13 and the circumferential speed of the cutter 26 are matched to each other, so that the trailing end 72 of the sheet 2 is trimmed at right angles in respect to the transport direction T, all as depicted in FIG. 2.

This sheet 2 having a first cut 74 is now inspected in the second inspection device 4. In the inspection process a front side or obverse side of the sheet 2, and a fresh edge of the sheet 2 or cut registration resulting from the trimmed end 72 are inspected.

Thereafter, the chain gripper system 16 passes the front end 71 of this sheet 2 on to a gripper system of the storage drum 29. This storage drum 29 conveys the sheet 2 in the direction toward the turning drum 31. When the front end 72 of this sheet now reaches the area of the suction systems 33 of the storage drum, the latter aspiratas the new trimmed trailing end 72. Subsequently, the suction systems 33 of the storage drum 29 move in an approximate arrow shape away from the center of the storage drum 29 and in this way tense the sheet 2 in the circumferential direction as well as in the direction toward lateral edges of the sheet 2.

The phase shift between the turning drum 31 and the storage drum 29 is set to the length of the sheets 2 to be processed. The storage drum 29 conveys the front end 71 of the sheet 2 through the gap between the turning, 31 drum and storage drum 29 until the suction systems 33 reach this gap. The trimmed end 72 of the sheet 2 is grasped by the first gripper system 34 of the turning drum 31 and is released from the suction system 33 by turning off the vacuum. Thereafter both gripper systems 34, 36 of the turning drum 31 are pivoted against each other, and the trimmed end 72 of sheet 2 is passed from the first gripper system 34 to the second gripper system 36. In their continued course the gripper systems 34, 36 pivot back into their initial position.

The trimmed end 72 is now grasped by the gripper system 36 so that it leads, and the untrimmed front end 71 trails.

The sheet 2 is passed on by the turning drum 31 to a pair of gripper systems 39, 41, or respectively 42, 43 of the processing cylinder 37. On the processing cylinder 37, the sheet 2 is provided with three cuts 76, 77, 78 in the longitudinal direction—i.e. in the transport direction T—. Narrow strips 79, 81 are cut off the two longitudinal sides of the sheet 2 by the second and third cut 76, 77. These cuts 76, 77, 78 and strips 79, 81 can be seen in FIG. 2.

The gripper division or size of the gripper systems 39, 41, 42, 43 of the processing cylinder 37, and the width, as well as the position, of the sheet 2, are matched to each other in such a way that the two cut-off strips 79, 81 are not grasped by the grippers.

The fourth cut 78 separates the sheet 2 in the center into two partial sheets 82, 83. Here, too, there is no gripper in the area of the cut 78.

Figure 5:
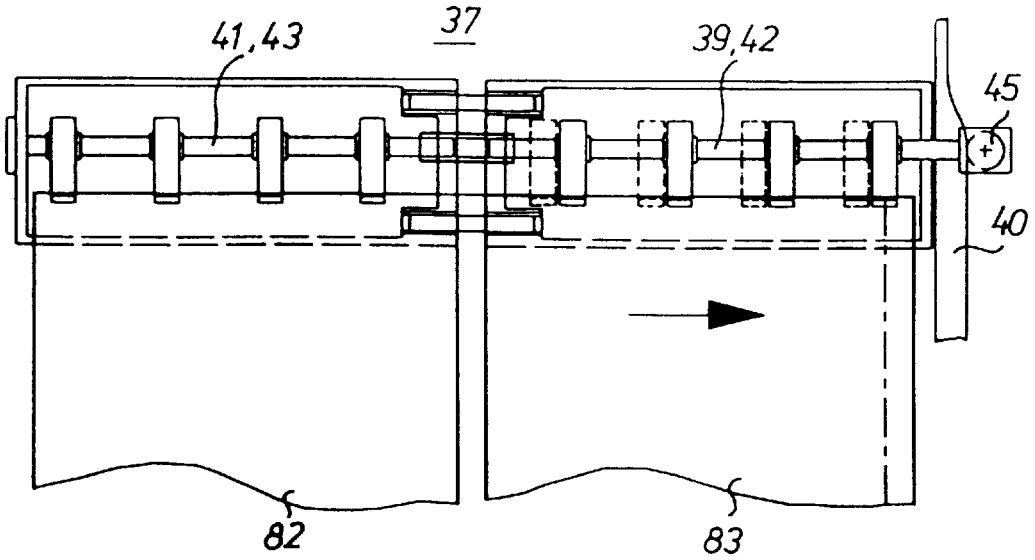

When these three longitudinal cuts 76, 77, 78 are completely performed, also at the maximum length of the sheet 2, the two partial sheets 82, 83 are moved apart in the axial direction. To this end, in the present invention a gripper system 41, or respectively 43, or 39, or respectively 42, performs a lifting motion in the axial direction by means of a cam roller 45 working together with a cam disk 40, as shown in FIG. 5. Only after these two partial sheets 82, 83 have been moved away from each other are these two partial sheets 82, 83 passed on to a chain gripper system 49 of the second chain conveyor 47 in the area of the first chain wheel shaft 51. The gripper system 41, or respectively 43, of the processing cylinder 37 is moved back into its initial position before the next sheet 2 is taken over.

The spaced-apart partial sheets 82, 83 are conveyed on in a common conveying direction, or respectively plane.

The two partial sheets 82, 83 are conducted to the second transverse cutting device 57 by this chain gripper system 49. To steady the sheet 2, it is aspirated along the suction box 56 which is connected upstream of the second transverse cutting device 57. The previously trimmed end 72 of the partial sheets 82, 83 in the chain gripper system 49 is already passed over the suction box 61 of the third inspection device 6. From the untrimmed initial front 71 of the sheet 2, i.e. of the two pulled-apart partial sheets 82, 83, which now trails, a strip 86 is axially cut off at right angles in respect to the transport direction T by means of a fifth cut 84. The sheet 2 has now been trimmed on all sides and has been separated into two partial sheets 82, 83.

A back or reverse side of the sheet 2, i.e. the backs of the two partial sheets 82, 83, together with the edges trimmed in the longitudinal direction, and the now trailing front 71 of the sheets 2, i.e. the trailing ends of the partial sheets 82, 83 trimmed in the axial direction, are checked by the third inspection device 6.

The inspection devices 4, 6 check the cut registration of the sheets 2, 82, 83, i.e. the position of at least one trimmed edge, preferably of all trimmed edges of the sheets 2, 82, 83 in relation to a reference marker, for example within a printed image. Preferably the entire sheets, including the entire printed image, are checked.

The chain conveyor 47 conveys the partial sheets 82, 83, which have been trimmed on all sides and checked on front and back, from the third inspection device 6 to selected ones of the six stacks 63, 64, 66 to 69 of the feeder 62. There, the partial sheets 82, 83 can be selectively deposited on one of the six stacks 63, 64, 66 to 69. In this connection, the first four stacks 63, 64, 66, 67 preferably receive so-called "good" sheets, and the two last stacks 67, 68, which are arranged next to each other, receive waste sheets.

In place of sheets 2, 82, 83, it is also possible, for example, to trim or cut printed webs, i.e. printed materials, and to subsequently check them by means of one or several inspection devices 3, 4, 6. In this case, the cutting devices 1, 38, 57 can be arranged, for example, in the area of a folding mechanisms of a web-fed rotary printing press.

There, a web is cut, for example in the longitudinal direction, into several partial webs, and is subsequently cut into signatures in the transverse direction. In this case the cut registration can be checked after each step, or after the web has been cut completely into signatures.

The inspection devices 3, 4, 6 preferably contain one or several CCD area cameras, which check the sheet as a whole.

While a preferred embodiment of a sheet processing machine in accordance with the present invention has been set forth fully and completely herein above, it will be apparent to one of skill in the art that a number of changes in, for example, the type of printing press used with the sheet processing machine, the apparatus used to deliver and remove the sheet stacks and the like could be made without departing from the true spirit and scope of the present invention which is accordingly to be limited only by the following claims.

What is claimed is:

1. A sheet processing machine comprising:

a chain conveyor for transporting a plurality of sheets;

at least one chain gripper system on said chain conveyor;

at least two axially spaced holding systems in said at least one chain gripper system;

means for displacing at least one of said holding systems axially and for actuating each of said holding systems independently; and a plurality of sheet receiving stacks, each of said stacks being positioned to receive sheets from said holding systems.

* * * * *